US009532419B2

(12) United States Patent
Takahashi

(10) Patent No.: US 9,532,419 B2
(45) Date of Patent: Dec. 27, 2016

(54) LIGHTING APPARATUS, ILLUMINATION LIGHT SOURCE, AND POWER SUPPLY UNIT

(71) Applicant: PANASONIC INTELLECTUAL PROPERTY MANAGEMENT CO., LTD., Osaka (JP)

(72) Inventor: Akira Takahashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/828,570

(22) Filed: Aug. 18, 2015

(65) Prior Publication Data

US 2016/0073458 A1 Mar. 10, 2016

(30) Foreign Application Priority Data

Sep. 9, 2014 (JP) ..... 2014-183693

(51) Int. Cl.

| | |
|---|---|
| ***H05B 41/16*** | (2006.01) |
| ***H05B 41/24*** | (2006.01) |
| ***H05B 33/08*** | (2006.01) |
| ***F21V 23/00*** | (2015.01) |
| *H05B 37/02* | (2006.01) |
| *F21Y 101/00* | (2016.01) |

(52) U.S. Cl.

CPC ..... *H05B 33/0815* (2013.01); *F21V 23/009* (2013.01); *H05B 33/0809* (2013.01); *F21V 23/007* (2013.01); *F21Y 2101/00* (2013.01); *H05B 37/0272* (2013.01)

(58) Field of Classification Search

None

See application file for complete search history.

(56) References Cited

U.S. PATENT DOCUMENTS

| | | | | |
|---|---|---|---|---|
| 6,227,679 | B1 * | 5/2001 | Zhang | F21K 9/135 257/E25.028 |
| 7,758,223 | B2 | 7/2010 | Osawa et al. | |
| 8,398,272 | B2 | 3/2013 | Osawa | |
| 8,858,041 | B2 | 10/2014 | Osawa et al. | |
| 8,979,315 | B2 | 3/2015 | Osawa et al. | |
| 8,992,041 | B2 | 3/2015 | Osawa | |
| 9,080,759 | B2 | 7/2015 | Osawa et al. | |
| 2006/0227558 | A1 | 10/2006 | Osawa et al. | |
| 2009/0295300 | A1 * | 12/2009 | King | H05B 33/0815 315/209 R |
| 2010/0134049 | A1 * | 6/2010 | Matsuoka et al. | 315/307 |
| 2010/0237761 | A1 | 9/2010 | Osawa et al. | |

(Continued)

FOREIGN PATENT DOCUMENTS

JP 2006-313717 11/2006

*Primary Examiner* — Anh Tran

(74) *Attorney, Agent, or Firm* — Greenblum & Bernstein, P.L.C.

(57) ABSTRACT

A lighting apparatus in which a light emitter (an illumination light source) can be easily reduced in size is provided. The lighting apparatus includes: a light emitter; and an inverter circuit that converts power supplied from a commercial power supply, into AC power, and outputs the AC power to the light emitter, and the light emitter includes: a capacitor; a rectifier circuit that rectifies the AC power obtained through the capacitor; and an LED that emits light using power rectified by the rectifier circuit.

11 Claims, 8 Drawing Sheets

(56) References Cited

U.S. PATENT DOCUMENTS

| | | | | |
|---|---|---|---|---|
| 2010/0237779 | A1 | 9/2010 | Osawa et al. | |
| 2010/0244650 | A1 | 9/2010 | Osawa et al. | |
| 2010/0244694 | A1 | 9/2010 | Osawa et al. | |
| 2010/0253200 | A1 | 10/2010 | Osawa et al. | |
| 2011/0156569 | A1 | 6/2011 | Osawa | |
| 2011/0279033 | A1* | 11/2011 | Yang | H05B 37/0272 315/86 |
| 2011/0309386 | A1 | 12/2011 | Osawa et al. | |
| 2011/0310606 | A1 | 12/2011 | Osawa et al. | |
| 2012/0294005 | A1 | 11/2012 | Osawa et al. | |
| 2012/0294006 | A1 | 11/2012 | Osawa et al. | |
| 2012/0300458 | A1 | 11/2012 | Osawa et al. | |
| 2012/0300477 | A1 | 11/2012 | Osawa et al. | |
| 2013/0148364 | A1 | 6/2013 | Osawa | |
| 2013/0278152 | A1* | 10/2013 | Zhang | H05B 33/0821 315/185 R |
| 2013/0307427 | A1* | 11/2013 | Liang | H05B 37/02 315/201 |
| 2014/0078744 | A1 | 3/2014 | Osawa et al. | |
| 2014/0078750 | A1 | 3/2014 | Osawa et al. | |
| 2014/0078751 | A1 | 3/2014 | Osawa et al. | |
| 2014/0104837 | A1 | 4/2014 | Osawa et al. | |
| 2014/0204571 | A1* | 7/2014 | Zhang et al. | 362/222 |
| 2015/0092449 | A1* | 4/2015 | Demuynck | H05B 33/0803 362/649 |
| 2015/0257222 | A1* | 9/2015 | Siessegger et al. | 315/291 |

* cited by examiner

LIGHTING APPARATUS, ILLUMINATION LIGHT SOURCE, AND POWER SUPPLY UNIT

CROSS REFERENCE TO RELATED APPLICATION

This application claims the benefit of priority of Japanese Patent Application Number 2014-183693 filed on Sep. 9, 2014, the entire content of which is hereby incorporated by reference.

BACKGROUND OF THE INVENTION

1. Field of the Invention

The present disclosure relates to a lighting apparatus, an illumination light source, and the like that include a light-emitting element such as a light-emitting diode (LED).

2. Description of the Related Art

Semiconductor light-emitting elements, such as LEDs, are small and highly efficient with a long product life, and therefore are expected to be a light source of various products. Particularly, LED bulbs (bulb-shaped LED lamps) have been under development as an illumination light source that will replace existing fluorescent and incandescent bulbs (Japanese Unexamined Patent Application Publication No. 2006-313717).

For example, an LED bulb includes an LED module, a globe covering the LED module, a driving circuit that causes the LED module to emit light, a circuit case that houses the driving circuit, and a base that receives power from outside.

SUMMARY OF THE INVENTION

The driving circuit incorporated in an illumination light source, such as the above LED bulb, typically includes an inverter circuit that converts power supplied from a power supply. A problem with such a structure is that it is difficult to reduce the size of the illumination light source because of the need to make room inside the illumination light source for the driving circuit.

Thus, an object of the present disclosure is to provide a lighting apparatus and the like in which an illumination light source (a light emitter) can be easily reduced in size.

According to one aspect of the present disclosure, a lighting apparatus includes: a light emitter; and a power converter that converts power supplied from a power source, into alternating-current (AC) power, and outputs the AC power to the light emitter, wherein the light emitter includes: a capacitor; a rectifier circuit that rectifies the AC power obtained through the capacitor; and a light-emitting element that emits light using power rectified by the rectifier circuit.

According to one aspect of the present disclosure, an illumination light source includes: a base through which alternating-current (AC) power is supplied; a capacitor having one electrode connected to the base; a rectifier circuit that is connected to an other electrode of the capacitor and rectifies AC power obtained from the other electrode; and a light-emitting element that emits light using power rectified by the rectifier circuit.

According to one aspect of the present disclosure, a power supply unit includes: a terminal through which power is supplied from a locking-type ceiling box; a current regulator that outputs current using the power supplied through the terminal from the locking-type ceiling box; and a power supplier through which the current outputted by the current regulator is supplied to a light fixture.

According to the lighting apparatus and the like according to one aspect of the present disclosure, the light emitter can be easily reduced in size.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DETAILED DESCRIPTION OF THE PREFERRED EMBODIMENT

Hereinafter, a lighting apparatus and an illumination light source (a light emitter) according to an embodiment are described with reference to the accompanying drawings. Note that the embodiment described below shows a specific example of the present disclosure. Therefore, the numerical values, shapes, materials, structural elements, arrangement and connection of the structural elements, etc., shown in the following embodiment are mere examples, and are not intended to limit the present disclosure. Consequently, among the structural elements in the following embodiment, elements not recited in any one of the independent claims which indicate the broadest concepts of the present disclosure are described as arbitrary structural elements.

Note that the respective figures are schematic diagrams and are not necessarily precise illustrations. Additionally, substantially the same structural elements in the figures share the same reference signs, and description that would overlap may be omitted or simplified.

Embodiment 1

Overall Structure of Lighting Apparatus

Figure 1:
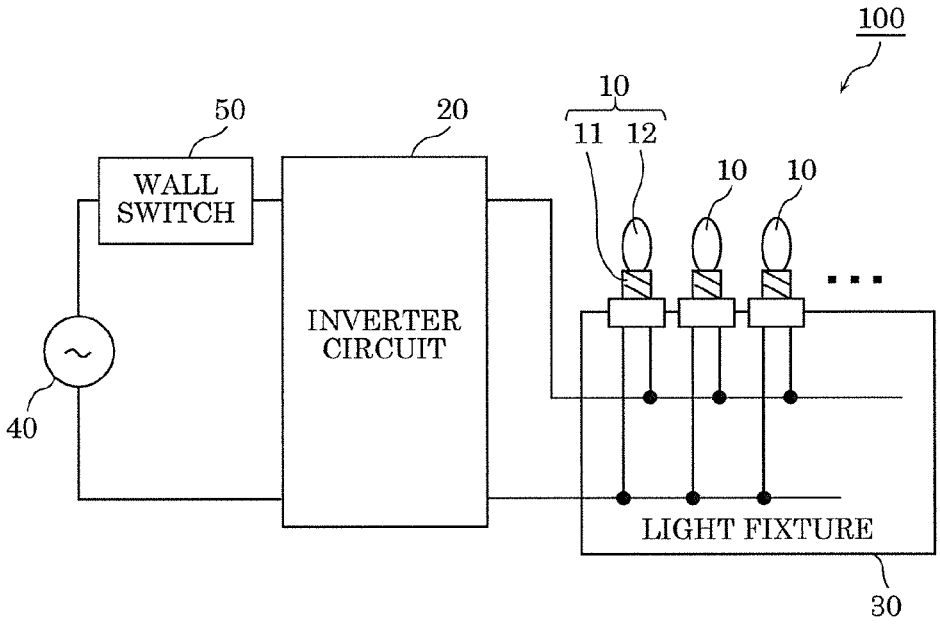
FIG. 1 is a schematic view illustrating a functional structure of a lighting apparatus according to an embodiment of the present disclosure.
Figure 2:
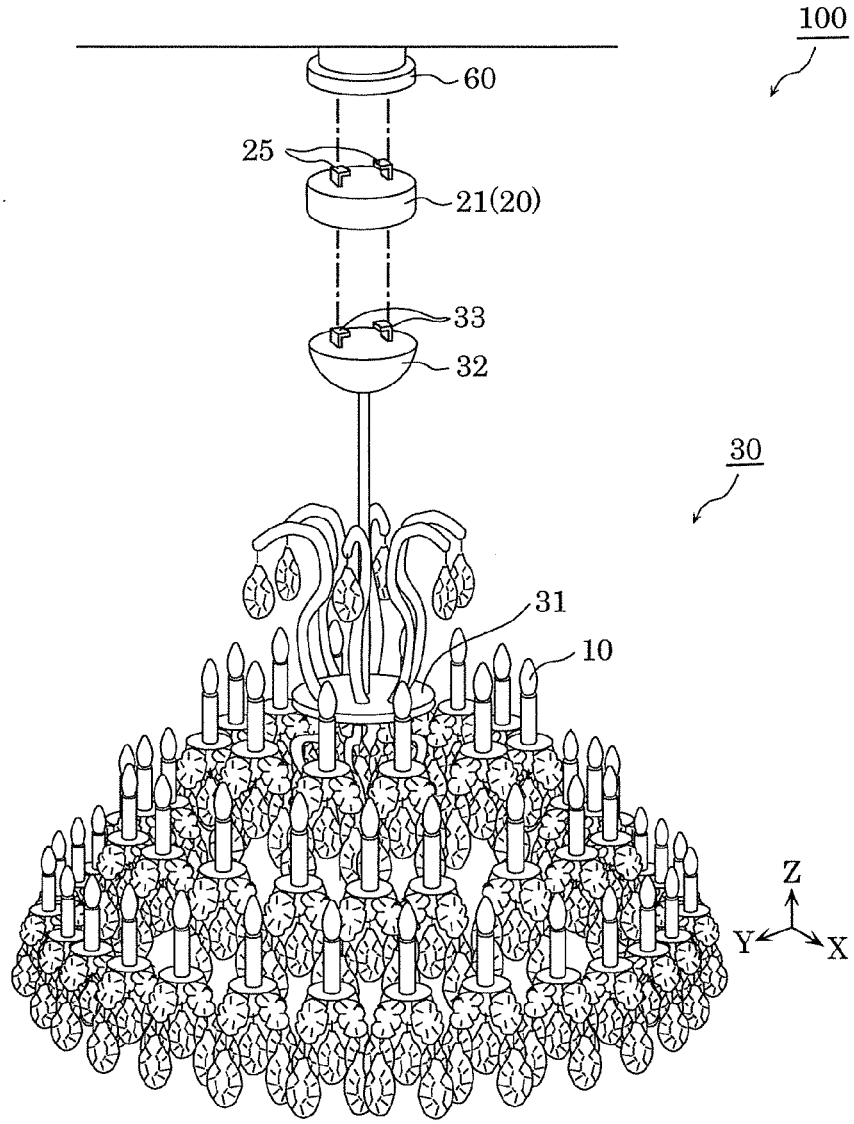
FIG. 2 is a perspective view illustrating an outer appearance of a lighting apparatus according to an embodiment of the present disclosure.

First, a lighting apparatus according to Embodiment 1 is described. FIG. 1 is a schematic view illustrating a functional structure of the lighting apparatus according to Embodiment 1. FIG. 2 is a perspective view illustrating an outer appearance of the lighting apparatus according to Embodiment 1. Note that in Embodiment 1 below, a ceiling-side surface of each structural element (that is on the positive side of the Z-axis) is referred to as an upper surface, and a floor-side surface of each structural element (that is on the negative side of the Z-axis) is referred to as a lower surface.

Lighting apparatus 100 according to Embodiment 1 includes a plurality of light emitters 10, inverter circuit 20 (that is incorporated in inverter circuit unit 21), and light fixture 30. Additionally, commercial power supply 40 and wall switch 50 are also illustrated In FIG. 1, and locking-type ceiling box 60 is also illustrated in FIG. 2.

Light emitter 10 is an illumination light source that is mounted on light fixture 30. The enclosure of light emitter 10 is formed by base 11 and globe 12. In Embodiment 1, light emitter 10 includes, for output of inverter circuit 20, a plurality of light emitters connected in parallel to each other.

Inverter circuit 20 converts, into AC power, power supplied from commercial power supply 40, and outputs the AC power to light fixture 30. Inverter circuit 20 is one example of a power converter and is provided outside light fixture 30. Specifically, inverter circuit 20 is incorporated in inverter circuit unit 21 separate from light fixture 30.

Inverter circuit unit 21 has terminal 25 on an upper surface and is mounted onto locking-type ceiling box 60 with terminal 25 being inserted into a terminal hole of locking-type ceiling box 60 and then turned.

Light fixture 30 is a light fixture of a chandelier form and includes: fixture main body 31 onto which a plurality of light emitters 10 are mounted; and locking-type ceiling cap 32 on which terminal 33 made of a metal (a power receiver of light fixture 30) is provided.

Light fixture 30 is mounted onto inverter circuit unit 21 mounted on locking-type ceiling box 60. Specifically, light fixture 30 is mounted onto inverter circuit unit 21 with terminal 33 being inserted into a terminal hole (not illustrated in FIG. 2) in a lower surface of inverter circuit unit 21 and then turned.

Commercial power supply 40 is an AC power supply having an effective value of 100 V and a commercial power supply frequency of 50 Hz or 60 Hz.

Wall switch 50 is a switch for allowing AC power to be supplied or not supplied from commercial power supply 40 to lighting apparatus 100. In addition to or instead of wall switch 50, a phase control dimmer, a pulse width modulation (PWM) dimmer, or the like may be used.

Locking-type ceiling box 60 is a supply port (an outlet) connecting to commercial power supply 40 installed in the ceiling of a building. In Embodiment 1, locking-type ceiling box 60 is a round full-locking-type ceiling outlet box. Examples of locking-type ceiling box 60 are a full locking-type rosette, a round locking-type ceiling box, a square locking-type ceiling box, a locking-type embedded rosette, and a locking-type exposed rosette.

Lighting apparatus 100 has the following features.

In a conventional structure, light fixture 30 is directly mounted on locking-type ceiling box 60, and AC power is directly supplied from commercial power supply 40 to a conventionally-structured light emitter through wiring in light fixture 30. The conventionally-structured light emitter incorporates an inverter circuit and emits light using power converted by the inverter circuit.

Lighting apparatus 100 is different from a lighting apparatus with such a conventional structure in that light emitter 10 is provided instead of the conventionally-structured light emitter and in that inverter circuit unit 21 is mounted between locking-type ceiling box 60 and light fixture 30. This means that lighting apparatus 100 can be implemented using existing light fixture 30.

Furthermore, in lighting apparatus 100, inverter circuit 20 is capable of converting, into AC power, power supplied from commercial power supply 40, and collectively controlling the plurality of light emitters 10 using the resultant AC power.

Moreover, in lighting apparatus 100, no inverter circuit is provided in light emitter 10, and therefore the light emitter can be easily reduced in size.

Detailed Structure of Light Emitter

Figure 3:
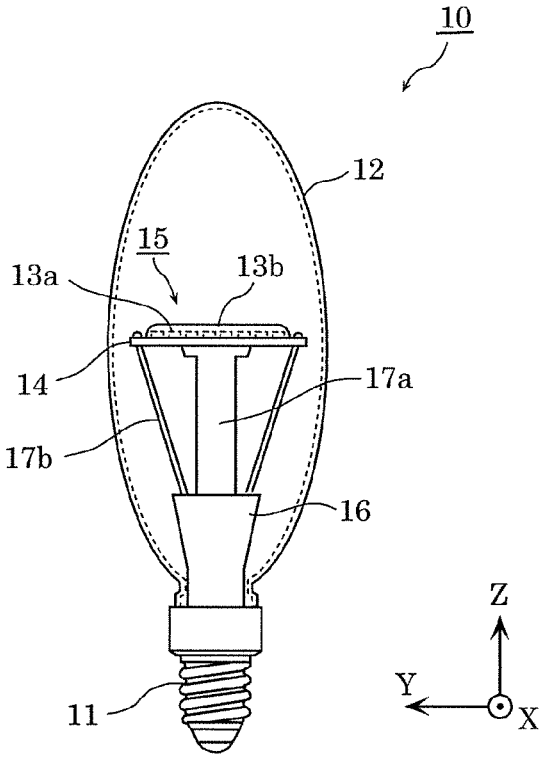
FIG. 3 is a side view of a light emitter.

Next, a detailed structure of light emitter 10 is described. FIG. 3 is a side view of light emitter 10.

Light emitter 10 is an illumination light source that is mounted onto light fixture 30 and includes, in more detail, base 11, globe 12, light-emitting module 15 (including LED 13*a*, sealing member 13*b*, and substrate 14), circuit case 16, rod 17*a*, and lead wire 17*b*.

Base 11 is a power receiver that is used for mounting of light emitter 10 onto light fixture 30 and through which AC power from inverter circuit 20 is supplied. In more detail, base 11 is connected to a socket provided on fixture main body 31 of light fixture 30.

An example of base 11 is an Edison screw type (E-type) base, but a plug-type base may also be used.

Globe 12 is a light-transmitting cover that forms the enclosure of light emitter 10 together with base 11, and transmits light emitted by LED 13*a*. Globe 12 is provided in such a way as to cover light-emitting module 15 and circuit case 16. Globe 12 is a spheroidal or candle-shaped globe.

Globe 12 is, for example, made of a resin material, such as acrylic (PMMA) or polycarbonate (PC), or a glass material. Globe 12 is transparent, but may be opaque white as long as it has light-transmitting properties.

Light-emitting module 15 has a plurality of LEDs 13*a* directly mounted on substrate 14 and sealed with sealing member 13*b*, that is, what is called a chip-on-board (COB) light-emitting module. Light-emitting module 15 is held on rod 17*a* inside globe 12. Although not illustrated in FIG. 3, the plurality of LEDs 13*a* are connected in series with bondwires.

LED 13*a* is specifically a blue LED chip which emits blue light. Sealing member 13*b* is specifically silicone resin that contains YAG yellow phosphor particles. With such a structure, part of blue light emitted by LED 13*a* is subject to wavelength conversion into yellow light due to the yellow phosphor particles contained in sealing member 13*b*. Blue light not absorbed by the yellow phosphor particles and the yellow light resulting from the wavelength conversion due to the yellow phosphor particles are mixed up into white light which is thereafter emitted.

Substrate 14 is a substrate that transmits visible light and onto the upper surface of which LEDs 13*a* are mounted. Substrate 14 is specifically a light-transmitting ceramic substrate made of polycrystalline alumina or aluminum nitride. Thus, as a result of substrate 14 having light-transmitting properties, it is possible to release white light also from a lower surface of substrate 14.

Circuit case 16 is for housing a circuit that drives light-emitting module 15. Circuit case 16 can be made from, for example, an insulating resin material such as polybutylene terephthalate (PBT).

As described above, a circuit inside circuit case 16 does not include the inverter circuit. A circuit configuration of such a circuit inside circuit case 16 is described later. Note that power is supplied from the circuit inside circuit case 16 to light-emitting module 15 through lead wire 17*b*.

Detailed Structure of Inverter Circuit Unit

Figure 4A:
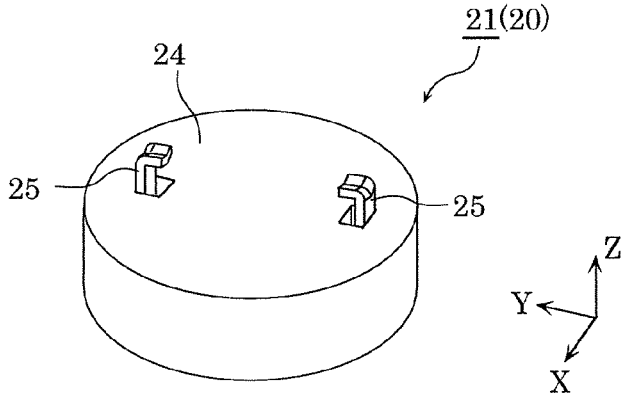
FIG. 4A is a perspective view of an inverter circuit unit seen from above.
Figure 4B:
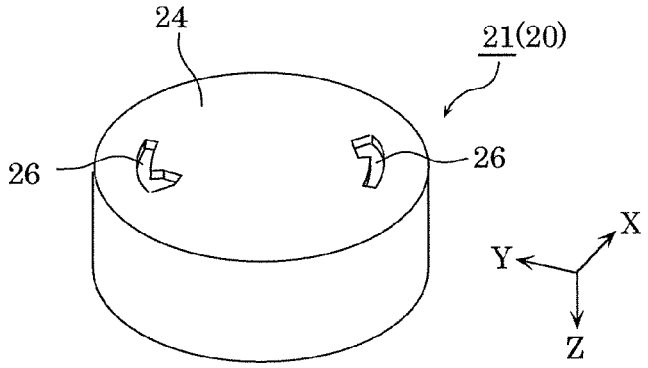
FIG. 4B is a perspective view of an inverter circuit unit seen from below.

Next, a detailed structure of inverter circuit unit 21 is described. FIG. 4A is a perspective view of inverter circuit unit 21 seen from above. FIG. 4B is a perspective view of inverter circuit unit 21 seen from below.

As illustrated in FIG. 4A, inverter circuit unit 21 includes terminal 25 above an upper surface of case 24 having a flat cylindrical shape (a disc shape). Terminal 25 is a metallic terminal for supplying power from commercial power supply 40 (locking-type ceiling box 60) to inverter circuit 20 provided inside case 24.

In the case of mounting inverter circuit unit 21 onto locking-type ceiling box 60, first, terminal 25 is inserted into the terminal hole of locking-type ceiling box 60. Inverter circuit unit 21 is then turned with respect to locking-type ceiling box 60 so that inverter circuit unit 21 is fixed to locking-type ceiling box 60. Consequently, commercial power supply 40 and inverter circuit 20 are electrically connected.

As illustrated in FIG. 4B, inverter circuit unit 21 has terminal hole 26 on a lower surface of case 24. In terminal hole 26, a metallic terminal (hereinafter referred to as an internal terminal) is provided which is for outputting AC power to light fixture 30 from inverter circuit 20 provided inside case 24. Terminal hole 26 is one example of a power supplier through which the AC power resulting from the conversion by inverter circuit 20 is supplied to light fixture 30.

In the case of mounting light fixture 30 onto inverter circuit unit 21, terminal 33 is inserted into terminal hole 26, and then locking-type ceiling cap 32 is turned with respect to inverter circuit unit 21 so that light fixture 30 is fixed to inverter circuit unit 21. At this time, the internal terminal is connected to terminal 33, with the result that inverter circuit 20 is electrically connected to light fixture 30.

Circuit Configuration and Operation of Inverter Circuit

Figure 5:
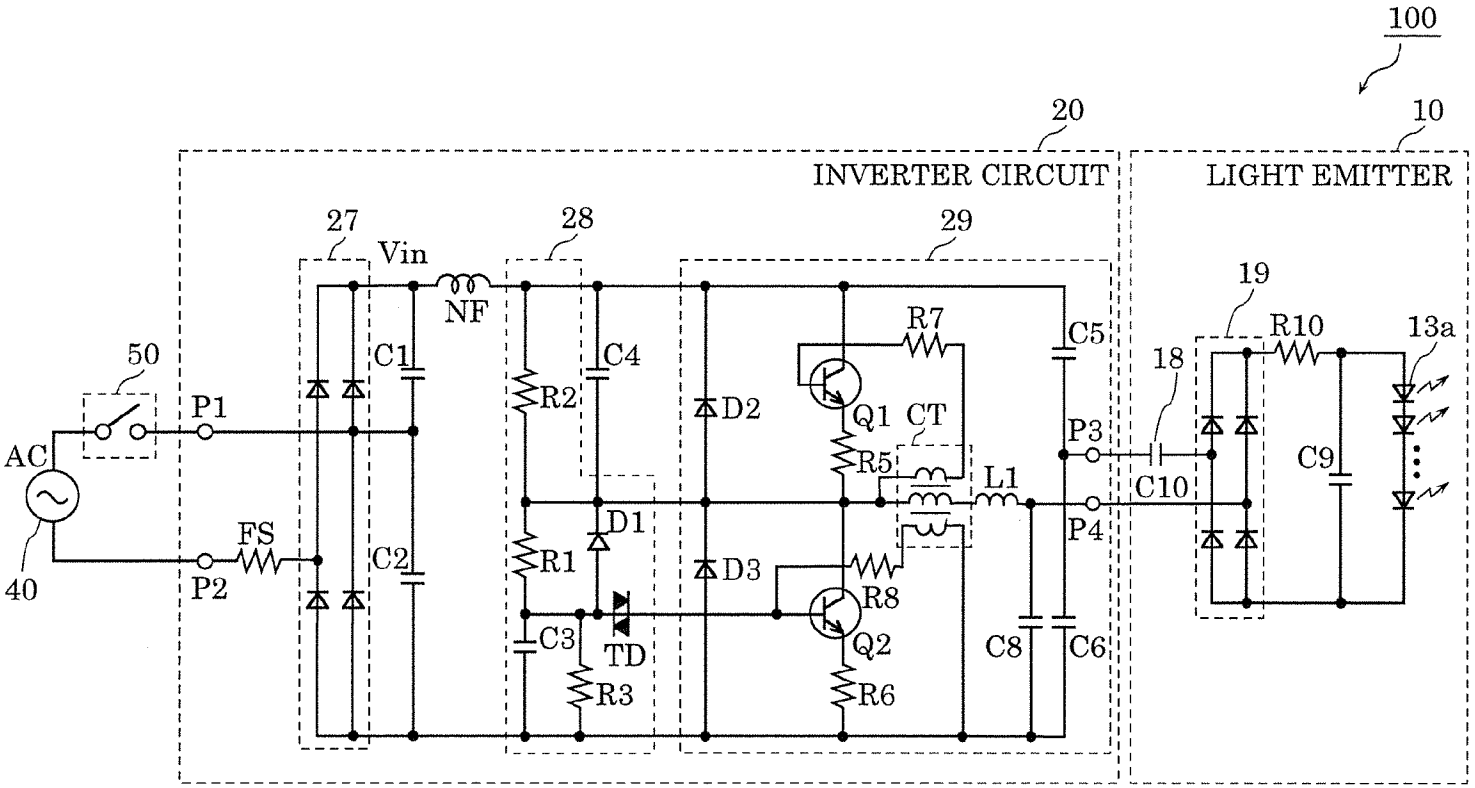
FIG. 5 is one example of a circuit diagram illustrating an inverter circuit and a circuit of a light emitter.

Next, configurations of inverter circuit 20 and a circuit of light emitter 10 are described. FIG. 5 is one example of a circuit diagram illustrating inverter circuit 20 and the circuit of light emitter 10. Note that light fixture 30 is present between inverter circuit 20 and light emitter 10 in practice, but an illustration of light fixture 30 is omitted in FIG. 5.

First, inverter circuit 20 is described. As illustrated in FIG. 5, inverter circuit 20 includes: converter 27 that rectifies AC power supplied from commercial power supply 40; inverter 29 that generates AC power for causing light emitter 10 to emit light; and inverter control circuit 28 that controls inverter 29.

Converter 27 is a full-wave bridge rectifier circuit made up of four diodes and has two input-side terminals connected to commercial power supply 40 via input terminals P1 and P2, and two output-side terminals connected to smoothing capacitors C1 and C2 and the like. Smoothing capacitors C1 and C2 are provided for stabilizing output voltage of converter 27. Input terminals P1 and P2 each correspond to terminal 25 described above.

Current fuse element FS is inserted to a wire that connects commercial power supply 40 and converter 27, so that they are connected in series. Furthermore, noise filter NF that removes switching noise is inserted to a wire that connects a negative terminal of the voltage output terminals of converter 27 and inverter control circuit 28.

Converter 27 receives AC voltage (for example, at 50 Hz or 60 Hz) from commercial power supply 40 through, for example, wall switch 50, treats the AC voltage with full-wave rectification, and outputs DC voltage. The DC voltage outputted from converter 27 is smoothened by smoothing capacitors C1 and C2 and then serves as DC input voltage Vin. Input voltage Vin is supplied to inverter 29 and inverter control circuit 28.

Inverter control circuit 28 is used for starting inverter 29. Inverter control circuit 28 includes trigger diode TD and a circuit that adjusts voltage that is applied across both ends of capacitor C3 depending on a ratio of partial pressures between resistors R1, R2, and R3. Capacitor C4 is a Snubber capacitor and is appropriately used to reduce switching loss by lowering the speed of changes in voltage of switching elements Q1 and Q2.

When input voltage Vin is input, trigger diode TD is placed in a conducting state as a result of breakover according to a voltage value based on charges held in capacitor C3. Since trigger diode TD is connected to the base of second switching element Q2 which is a control terminal of inverter 29, inverter 29 starts operating when trigger diode TD is placed in a conducting state.

Inverter 29 outputs AC power for causing light emitter 10 to emit light. Specifically, inverter 29 converts DC voltage into AC voltage. Inverter 29 is a self-excited, half-bridge inverter and includes a series circuit connected to a DC power supply. The series circuit includes first switching element Q1 and second switching element Q2 which alternately perform switching operations. First switching element Q1 and second switching element Q2 are each a bipolar transistor.

Drive transformer CT has winding coils including a primary winding (an input winding) and a secondary winding (an output winding). Inductor L1 is a choke inductor and has one end connected to drive transformer CT and the other end connected to output terminal P4.

Output terminals P3 and P4 each correspond to the above-described internal terminal (a terminal that is connected to terminal 33) in terminal hole 26.

Inverter 29 configured as described above starts operating when predetermined input voltage Vin is applied across both ends of the series circuit including first switching element Q1 and second switching element Q2, and a start-up control signal (a trigger signal) is supplied from inverter control circuit 28 to inverter 29. Specifically, first switching element Q1 and second switching element Q2 alternately perform ON and OFF operations by self oscillation thereof that is based on induction of drive transformer CT. With this, a secondary AC voltage attributed to series resonance of inductor L1 and capacitor C8 is induced, and outputted to output terminals P3 and P4.

The foregoing has described a circuit configuration and an operation of inverter circuit 20. Note that inverter circuit 20 described above is one example. Any other inverter circuit that is capable of supplying AC power to light emitter 10 may be used as inverter circuit 20.

As an example, assume that inverter circuit 20 is connected to a DC power supply rather than an AC power supply. In this case, inverter circuit 20 does not need converter 27, that is, a circuit that converts AC power into DC power. Therefore, inverter circuit 20 is replaced by other inverter circuit that has only a function of inverter 29 (inverter control circuit 28).

Circuit Configuration of Light Emitter

Next, a circuit configuration of light emitter 10 is described with reference to FIG. 5. Light emitter 10 includes capacitor 18, rectifier circuit 19, and a plurality of LEDs 13*a*. Furthermore, light emitter 10 includes resistor R10 and capacitor C9. Note that resistor R10 and capacitor C9 do not need to be provided.

Capacitor 18 is a capacitor (capacitor C10) that has one electrode (one end) connected to output terminal P3 of inverter circuit 20 and the other end connected to the input side of rectifier circuit 19. Note that one electrode of capacitor 18 is connected to output terminal P3 on the circuit diagram, but is connected to base 11 in practice.

Capacitor 18 serves as reactance to AC power outputted by inverter circuit 20. Due to capacitor 18, current that flows through LED 13*a* varies according to a frequency of AC power outputted from inverter circuit 20. Such an operation is described later.

Rectifier circuit 19 is a full-wave bridge rectifier circuit made up of four diodes as with converter 27. One of two input-side terminals of rectifier circuit 19 is connected to the other electrode of capacitor 18, and the other of the two input-side terminals of rectifier circuit 19 is connected to output terminal P4 of inverter circuit 20. One of two output-side terminals of rectifier circuit 19 that has a higher potential is connected to the anode side of the plurality of LEDs 13*a* connected in series, and the other of the two output-side terminals of rectifier circuit 19 that has a lower potential is connected to the cathode side of the plurality of LEDs 13*a* connected in series.

Rectifier circuit 19 performs full-wave rectification on the AC power obtained via capacitor 18 (the other electrode of capacitor 18). Power outputted after the full-wave rectification is smoothened by capacitor C9 and then supplied to LED 13*a*. LED 13*a* emits light using power rectified by rectifier circuit 19.

Advantageous Effect

Figure 6:
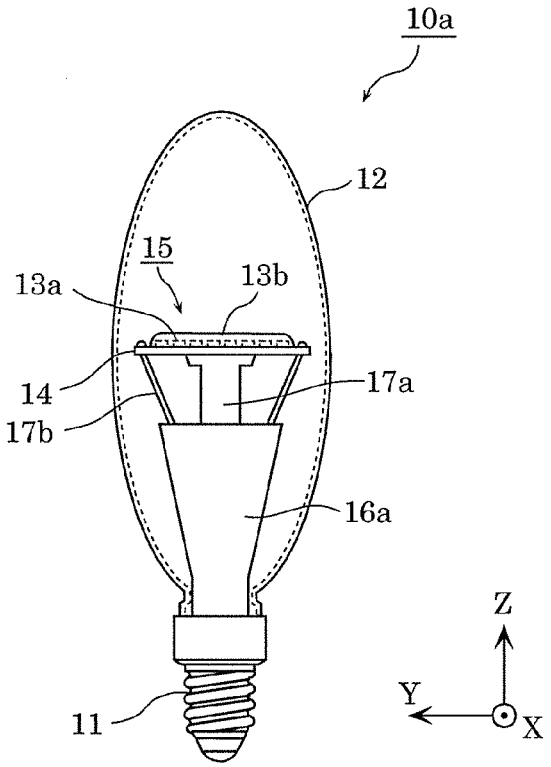
FIG. 6 is a side view illustrating a light emitter incorporating an inverter circuit.

As described above, inverter circuit 20 is provided outside light emitter 10 in lighting apparatus 100. An advantageous effect that is produced by lighting apparatus 100 is described below with reference to a comparative example. FIG. 6 is a side view illustrating a light emitter incorporating inverter circuit. 20

Inverter circuit 20 is incorporated in circuit case 16*a* of light emitter 10*a* illustrated in FIG. 6, whereas inverter circuit 20 is not incorporated in circuit case 16 of light emitter 10 described above and illustrated in FIG. 3. Thus, circuit case 16 is smaller than circuit case 16*a*. With circuit case 16 reduced in size as just described, it is easy to reduce the size of light emitter 10 itself.

Furthermore, a reduction in the size of circuit case 16 makes light from light-emitting module 15 less likely to be blocked by circuit case 16, meaning that it is possible to improve light distribution of light emitter 10.

In particular, a problem with light fixture 30 onto which light emitter 10 is mounted with globe 12 being at a position above base 11 is that it is necessary to ensure that a certain amount of light is directed downward, that is, in the direction to the floor. With regard to this problem, light emitter 10 can make room on base 11 side by reducing the size of circuit case 16, and therefore light can be directed to the floor as an advantageous effect.

In addition, when globe 12 is transparent as it is in light emitter 10, circuit case 16 is visible from the outside. With a structure such as that described above, a reduction in the size of circuit case 16 leads also to an advantageous effect of improving the design.

Figure 7:
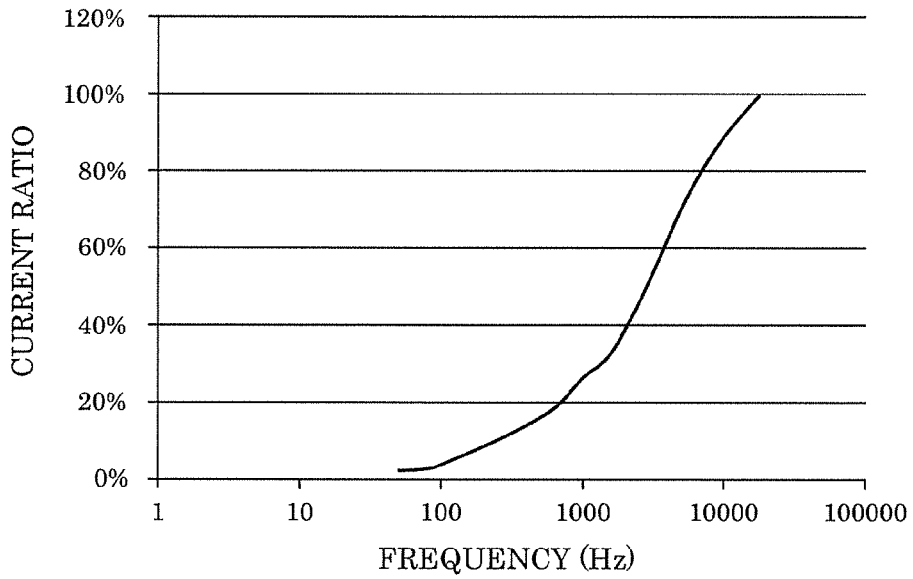
FIG. 7 illustrates a relationship between a frequency of AC power outputted by an inverter circuit and a ratio of current that flows through an LED.

In lighting apparatus 100, AC power outputted from inverter circuit 20 is input to rectifier circuit 19 via capacitor 18 in each light emitter 10. Therefore, brightness of light emitter 10 can be changed according to a frequency of the AC power outputted by inverter circuit 20. FIG. 7 illustrates a relationship between a frequency of the AC power outputted by inverter circuit 20 and a ratio of current that flows through LED 13*a*.

FIG. 7 illustrates a simulated result of a relationship between a frequency of a sine wave and current that flows through LED 13*a* (a current ratio), obtained assuming that as output of inverter circuit 20, a sine wave of Vp−p=45 V (constant) is input to the circuit of light emitter 10 described with reference to FIG. 5. A constant of the circuit of light emitter 10 is C10=0.47 uF and R10=1Ω, and a total of voltages Vf of the plurality of LEDs 13*a* connected in series is 27 V.

As illustrated in FIG. 7, current that flows through LED 13*a* depends on a frequency of output of inverter circuit 20. Specifically, more current flows through LED 13*a* as the frequency of output of inverter circuit 20 increases.

With the structure as described above, current that flows through light emitter 10 (LED 13*a*) primarily depends on a frequency of output of inverter circuit 20, and therefore influence such as wiring resistance between inverter circuit 20 and light emitter 10 can be reduced as an advantageous effect. For example, when the plurality of light emitters 10 are mounted on one light fixture 30 as in Embodiment 1, variations in brightness between the plurality of light emitters 10 due to a difference in wiring resistance inside light fixture 30 are less than those in the case where the plurality of light emitters 10 are supplied with DC power.

As described above, another advantage is that it is possible to easily provide lighting apparatus 100 by replacing an existing light emitter of light fixture 30 with light emitter 10 and mounting inverter circuit unit 21 between locking-type ceiling box 60 and light fixture 30.

It is conceivable that light fixture 30 with light emitter 10 mounted thereon is directly mounted on locking-type ceiling box 60 without inverter circuit unit 21 therebetween. In this case, there is a risk of power (the effective value of which is in the range from 100 V to 230 V, for example) of commercial power supply 40 being directly supplied to light emitter 10, causing malfunction of light emitter 10. In order to prevent excessive voltage from being applied to light emitter 10, the withstand voltage of capacitor 18 is preferably greater than or equal to 400 V.

Variation

A variation of Embodiment 1 is described below.

Figure 8:
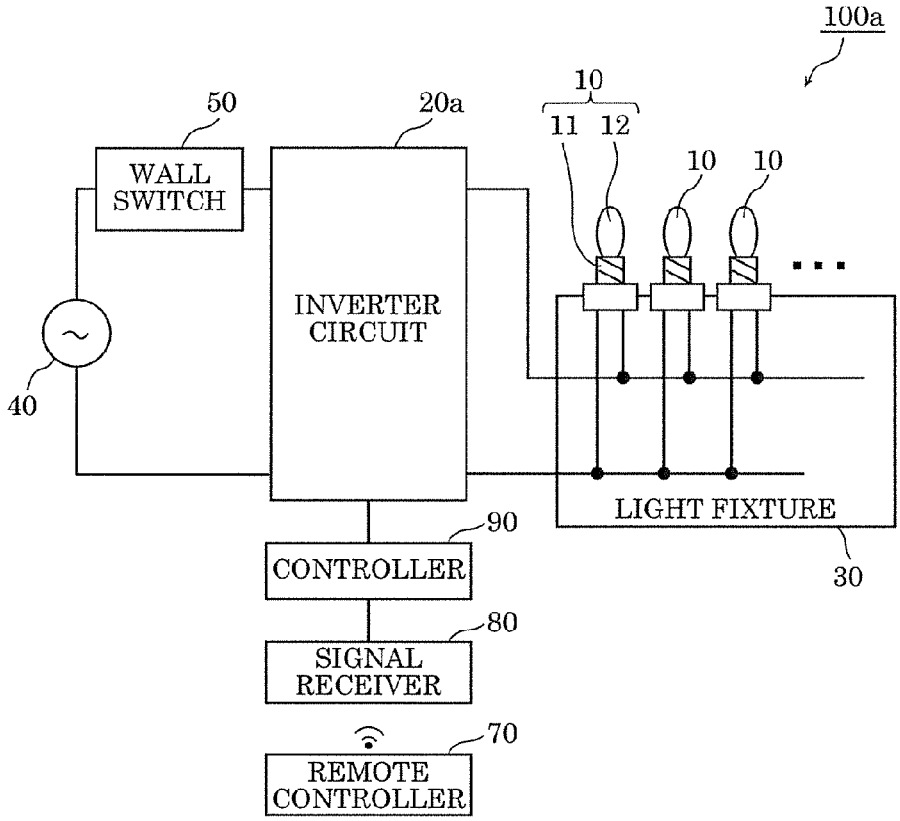
FIG. 8 is a schematic view illustrating a functional structure of a lighting apparatus according to a variation.

As described above, current that flows through each light emitter 10 depends on a frequency of output of inverter circuit 20 in lighting apparatus 100. Therefore, for example, the inverter circuit may control the brightness of light emitter 10 by changing the frequency of AC power that is outputted from the inverter circuit, based on an instruction from a user. FIG. 8 is a schematic view illustrating a functional structure of a lighting apparatus according to the variation as just described. In the following description of a lighting apparatus according to the variation, descriptions about structural elements that are substantially the same as those in lighting apparatus 100 may be omitted.

A major difference between lighting apparatus 100*a* illustrated in FIG. 8 and lighting apparatus 100 is that lighting apparatus 100*a* further includes remote controller 70, signal receiver 80, and controller 90.

Remote controller 70 is a user interface for lighting apparatus 100*a* and transmits a control signal to signal receiver 80 based on an instruction from a user. For the transmission of a control signal, wireless communication (for example, infrared communication) is used. The control signal is, in other words, a signal representing an instruction from a user about dimming.

Signal receiver 80 obtains the control signal from remote controller 70. Signal receiver 80 is specifically configured of an infrared light-receiving element, but may be configured of other wireless module.

When signal receiver 80 obtains a control signal, control unit 90 performs control of changing a frequency of output of inverter circuit 20*a* according to the obtained control signal. Control unit 90 is realized specifically by the use of a microcomputer, a processor, a dedicated circuit, or the like. Furthermore, control unit 90 may be realized by means of a program executing unit, such as a CPU and a processor, reading and executing a software program recorded on a recording medium such as a hard disk or a semiconductor memory.

Inverter circuit 20*a* collectively controls brightness of the plurality of light emitters 10 by changing a frequency of AC power that is outputted from inverter circuit 20*a*, based on the control by control unit 90. In this case, an inverter integrated circuit (IC) the output of which can be changed in frequency based on an external signal, for example, is used as inverter circuit 20*a*.

Lighting apparatus 100*a* configured as described above is capable of dimming based on an instruction from a user. Note that the configuration in FIG. 8 is one example, and other configuration may be adopted that can provide a dimming function based on an instruction from a user.

A frequency of output of inverter circuit 20*a* is preferably changeable in the range from 250 Hz to 75 kHz, considering the impact of noise in the bandwidth of 150 kHz or more, regulated under the standard for pulsating current in the Product Safety Electrical Appliance & Material (PSE) law (which exempts noise of 500 Hz or more), and under CISPR 15. Output of inverter circuit 20*a* may either be a sine wave or a square wave. From the aspect of noise, a square wave is more suited.

The effective value of AC power that is outputted by inverter circuit 20*a* and a total of voltages Vf of LEDs 13*a* connected in series are preferably lower than or equal to 50 V, from the aspect of specific requirements in the PSE law and the definition of extra-low voltage (ELV) in the Japanese Industrial Standards (JIS). The effective value of AC power that is outputted by inverter circuit 20*a* is more preferably less than or equal to the safety extra-low voltage (SELV) 25 V.

Other Embodiments

An embodiment has been described above, but the present disclosure is not limited to the above embodiment.

For example, although the inverter circuit is supplied with AC power from a commercial power supply in the above embodiment, the inverter circuit may be supplied with power from other AC power supply or a DC power supply.

Although one inverter circuit supplies AC power to a plurality of light emitters in the above embodiment, it may be that one inverter circuit supplies AC power to one light emitter. Also in this case, when the inverter circuit is provided separately from the light emitter, the light emitter can be easily reduced in size as an advantageous effect.

Although one inverter circuit supplies AC power to one light fixture in the above embodiment, it may be that one inverter circuit supplies AC power to a plurality of light fixtures.

Furthermore, although the inverter circuit is incorporated in the inverter circuit unit in the above embodiment, this is one example.

For example, the inverter circuit may be provided between the commercial power supply and the locking-type ceiling box. Specifically, electrical work may be performed so that a case (a ballast box) in which the inverter circuit is stored is installed on wiring provided above the ceiling and connecting the commercial power supply and the locking-type ceiling box. In this case, an existing light fixture is mounted onto the locking-type ceiling box as is conventionally done, and a light emitter is replaced. Thus, it is possible to implement the lighting apparatus using the existing light fixture. Alternatively, the inverter circuit may be incorporated in the light fixture.

The above embodiment describes inverter circuit unit 21 as one example of a power supply unit provided between locking-type ceiling box 60 and light fixture 30. Note that the inverter circuit is not essential for such a power supply unit as that described above, because the power supply unit only needs to control a light emitter mounted on light fixture 30, using current (that can be either direct current or alternating current).

Such a power supply unit as that described above includes, for example: terminal 25 through which power is supplied from locking-type ceiling box 60; a current regulator (a current-regulating circuit) that outputs current using the power supplied through terminal 25 from locking-type ceiling box 60; and a power supplier (terminal hole 26) through which the current outputted by the current regulator is supplied to light fixture 30.

The current regulator may include a DC to AC converter circuit to convert into DC power the AC power supplied from locking-type ceiling box 60, and output resultant DC power, for example. Alternatively, the current regulator may be an inverter circuit such as that described above and output AC power. In short, it is sufficient that the current regulator is configured to control a light emitter at least using current. When the current regulator outputs DC power, there is no need to provide capacitor 18 in light emitter 10, and therefore light emitter 10 can be further smaller.

Although the above embodiment describes bulb-shaped light emitter 10, the shape of the light emitter is not particularly limited. For example, the light emitter may be a straight tube illumination light source.

Although a COB light-emitting module is used as the light emitter in the above embodiment, a light-emitting module including a surface mount device (SMD) light-emitting element may be used. A light-emitting element of light emitter 10 may be a semiconductor light-emitting element such as a semiconductor laser or a solid-state light-emitting element such as an organic electroluminescent (EL) element or an inorganic EL element.

According to the present disclosure, the illumination light source (the above-described light emitter) may be implemented, or the power supply unit such as that described above may be implemented.

The circuit configuration illustrated in the above circuit diagram is one example, meaning that a circuit configuration according to the present disclosure is not limited to the above circuit configuration. In other words, the scope of the present disclosure covers a circuit that can provide a characteristic function described in the present disclosure in the same way as the above-described circuit configuration. For example, the scope of the present disclosure covers a device obtained by connecting to a certain element an element such as a switching element (a transistor), a resistor, or a capacitor, in series or in parallel, within the range in which the same or like function as the above-described circuit configuration can be provided. In other words, the wording "connected" in the above embodiment is not limited to the case where two terminals (nodes) are directly connected, but includes the case where the two terminals (nodes) are connected via an element within the range in which the same or like function can be provided.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus comprising:

a plurality of light emitters connected in parallel; and a power converter that converts power supplied from a power source, into alternating-current (AC) power, and outputs the AC power to the plurality of light emitters, wherein each of the plurality of light emitters includes:

a capacitor;

a rectifier circuit that rectifies the AC power obtained through the capacitor; and a light-emitting element that emits light using power rectified by the rectifier circuit, and the power converter outputs the AC power to the capacitor included in each of the plurality of light emitters, and wherein the power converter converts the power supplied from the power source, into sine wave AC power, and outputs the sine wave AC power to each of the plurality of light emitters, the sine wave AC power output by the power converter is input to the capacitor included in each of the plurality of light emitters, and the power converter controls brightness of each of the plurality of light emitters by changing a frequency of the sine wave AC power which is input to the capacitor.

2. The lighting apparatus according to claim 1, wherein each of the plurality of light emitters includes a base that is used for mounting of the light emitter onto a light fixture and through which the AC power is supplied.

3. The lighting apparatus according to claim 2, wherein each of the plurality of light emitters includes a globe that provides an enclosure of the light emitter together with the base, and transmits the light emitted by the light-emitting element, and the globe is positioned above the base when the light emitter is mounted onto the light fixture.

4. The lighting apparatus according to claim 1, wherein the power converter collectively controls brightness of the plurality of light emitters by changing a frequency of the AC power.

5. The lighting apparatus according to claim 1, wherein a withstand voltage of the capacitor is greater than or equal to 400 V.

6. The lighting apparatus according to claim 1, wherein a frequency of the AC power that is outputted by the power converter is in the range from 250 Hz to 75 kHz.

7. The lighting apparatus according to claim 1, wherein an effective value of the AC power that is outputted by the power converter is less than or equal to 50 V.

8. An illumination light source utilized as a light emitter included in the plurality of light emitters of the lighting apparatus according to claim 1.

9. A power supply unit comprising:

a terminal through which alternating current AC power is supplied from a locking-type ceiling box;

a current regulator that outputs sine wave AC current using the AC power supplied through the terminal from the locking-type ceiling box, the AC current having a frequency higher than a frequency of the AC power; and a power supplier through which the sine wave AC current output by the current regulator is supplied to a light fixture.

10. The power supply unit according to claim 9, wherein the current regulator outputs the AC power.

11. The power supply unit according to claim 10, wherein a light emitter is mounted on the light fixture, and the current regulator outputs the AC current to the light emitter through the power supplier, to cause the light emitter to emit light.

* * * * *